US005577458A

United States Patent [19]

Kohl

[11] Patent Number: 5,577,458

[45] Date of Patent: Nov. 26, 1996

[54] PEDESTAL MOUNTED SEAT TACKLE BOX ASSEMBLY

[76] Inventor: Rex L. Kohl, 11152 Jackson Dr., Eden Prairie, Minn. 55347

[21] Appl. No.: 504,440

[22] Filed: Jul. 20, 1995

[51] Int. Cl.[6] ..... B63B 17/00

[52] U.S. Cl. ..... 114/363; 114/364

[58] Field of Search ..... 114/343, 363, 114/364; 297/188.08, 188.09, 188.11, 188.13, 188.01

[56] References Cited

U.S. PATENT DOCUMENTS

| | | | |
|---|---|---|---|
| 2,264,744 | 12/1941 | Dunnam . | |
| 3,230,006 | 1/1966 | Sokolis . | |
| 4,398,488 | 8/1983 | Mathieu | 114/363 |
| 4,428,617 | 1/1984 | Lawson | 114/363 |
| 4,682,813 | 7/1987 | Fohr et al. . | |
| 4,745,704 | 5/1988 | Schaefer . | |
| 4,773,709 | 9/1988 | Slinkard | 114/363 |
| 4,790,432 | 12/1988 | Rees . | |
| 4,854,261 | 8/1989 | Goldsmith | 114/363 |
| 5,048,447 | 9/1991 | Vicari | 114/364 |
| 5,052,325 | 10/1991 | Rhines . | |

*Primary Examiner*—Stephen Avila

*Attorney, Agent, or Firm*—Merchant, Gould, Smith, Edell, Welter & Schmidt, P.A.

[57] ABSTRACT

A pedestal mounted seat storage base assembly for mounting on a pedestal base plate, the assembly comprising:

a storage base having a top and a bottom;

a seat mounted on the storage base; and a pedestal base plate adaptor mounted on the bottom of the storage base and configured for mounting on the pedestal base plate whereby the seat storage base assembly is vertically supported.

22 Claims, 12 Drawing Sheets

PEDESTAL MOUNTED SEAT TACKLE BOX ASSEMBLY

BACKGROUND OF THE INVENTION

The present invention relates to a pedestal mounted seat and storage base assembly. In particular the invention relates to a pedestal mounted seat tackle box assembly and a pedestal mounted seat cooler assembly.

The present invention offers a substantial improvement in the storage of items while taking up minimal floor space.

SUMMARY OF THE INVENTION

The present invention relates to a pedestal mounted seat and storage base assembly.

One embodiment of the invention relates to a pedestal mounted seat storage base assembly for mounting on a pedestal base plate, the assembly comprising: a storage base having a top and a bottom; a seat mounted on the storage base; and a pedestal base plate adaptor mounted on the bottom of the storage base and configured for mounting on the pedestal base plate whereby the seat storage base assembly is vertically supported.

Yet another embodiment relates to a fishing boat pedestal mounted seat tackle box assembly for mounting on a floor mounted pedestal base plate, the assembly comprising: a compartmented tackle box having a top and a bottom; a seat mounted on the compartmented tackle box; and a pedestal base plate adaptor mounted on the bottom of the tackle box and configured for mounting on the pedestal base plate whereby the seat tackle box assembly is supported above the floor of the fishing boat.

Still another embodiment relates to a fishing boat pedestal mounted seat cooler assembly for mounting on a floor mounted pedestal base plate, the assembly comprising: a cooler having a top and a bottom; a seat mounted on the cooler; and a pedestal base plate adaptor mounted on the bottom of the cooler and configured for mounting on the pedestal base plate whereby the seat cooler assembly is supported above the floor of the fishing boat.

Yet another embodiment relates to a fishing boat, comprising a plurality of floor mounted pedestal base plates and at least one seat storage base assembly interchangeably mountable on the pedestal base plates. The seat storage base assemblies include a storage base having a top and a bottom; a seat mounted on the storage base; and a pedestal base plate adaptor mounted on the bottom of the base and configured for mounting on the pedestal base plates whereby the seat storage base assembly is supported above the floor of the fishing boat.

One advantage of one embodiment of the present invention is the provision of usable storage space beneath pedestal mounted seats. The storage space might be used to store individual storage trays. The trays might include at least one articulated portion and an unarticulated portion. The storage space might also be used to store refrigerated beverages, food and bait.

Another advantage of one embodiment of the present invention is the inclusion of a tapered storage base which assists in sheltering bait, tackle, food, etc. from direct sunlight as the seat will serve to protect the storage base from direct sunlight.

Yet another advantage of one embodiment of the invention is the provision of a storage area directly under the seat so as to reduce the need for storage items cluttered about the floor.

These and various other features and advantages of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings in which like reference numerals and letters generally indicate corresponding parts throughout the several views.

DETAILED DESCRIPTION OF PREFERRED EMBODIMENT(S)

Figure 1:
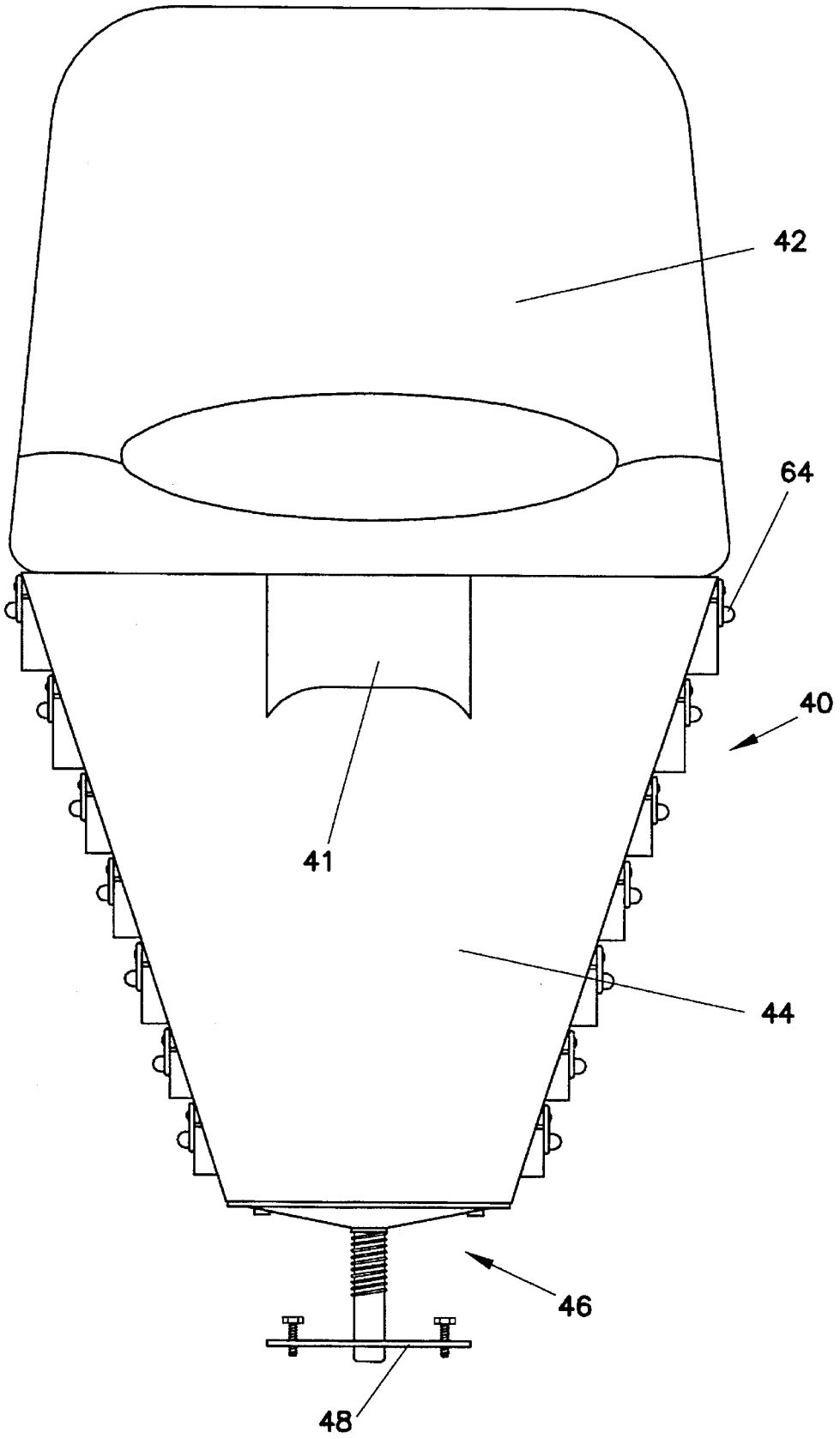
FIG. 1 is a front elevational view of a pedestal mounted seat tackle box assembly generally in accordance with the principles of the invention.
Figure 2:
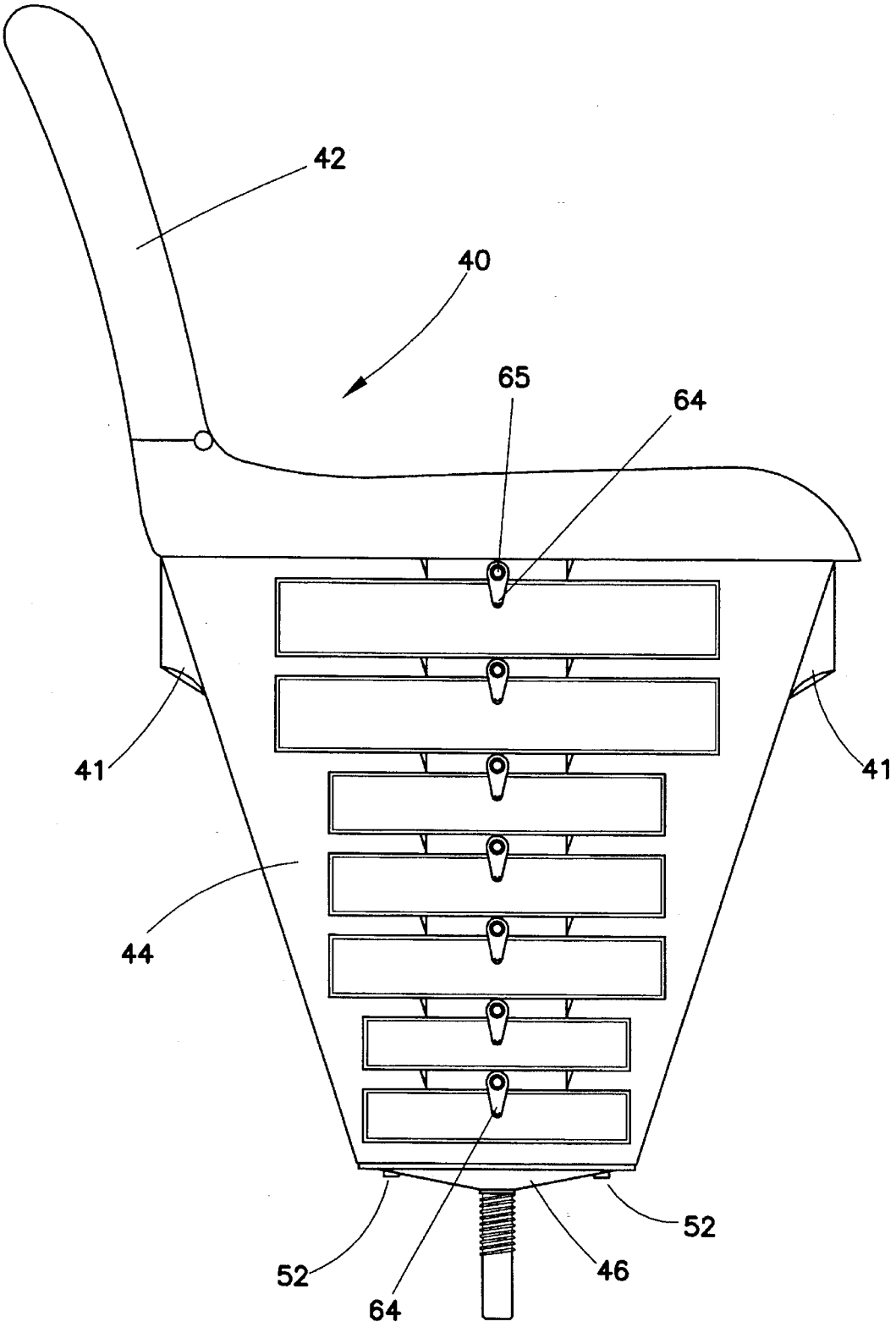
FIG. 2 is a side elevational view of the embodiment shown in FIG. 1, rotated 90 degrees.
Figure 3:
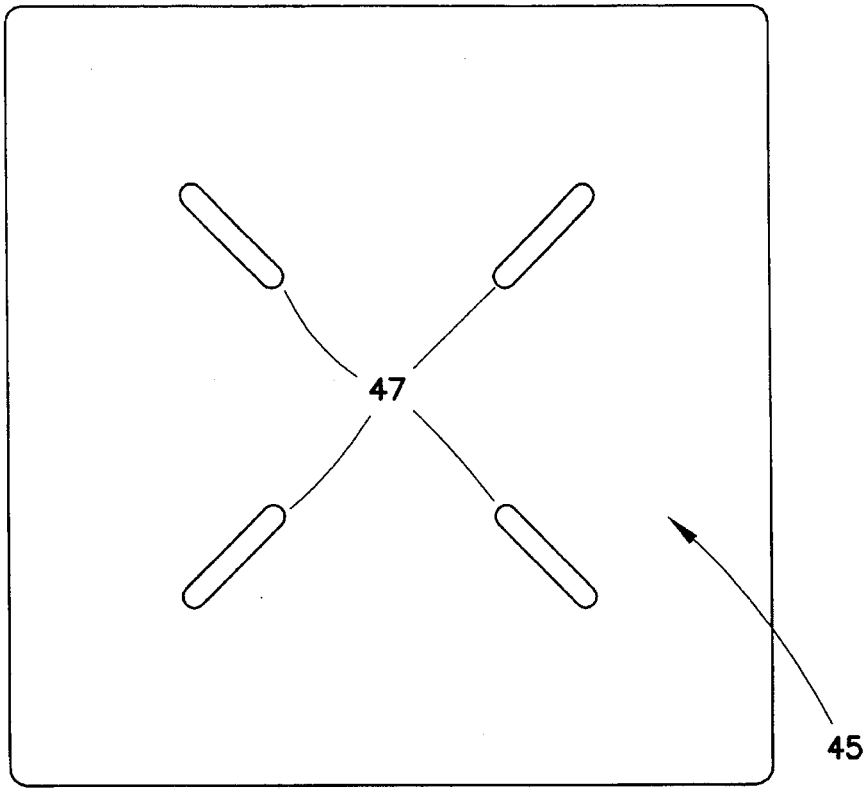
FIG. 3 is a top view of the tackle box portion of the embodiment shown in FIG. 1.
Figure 4:
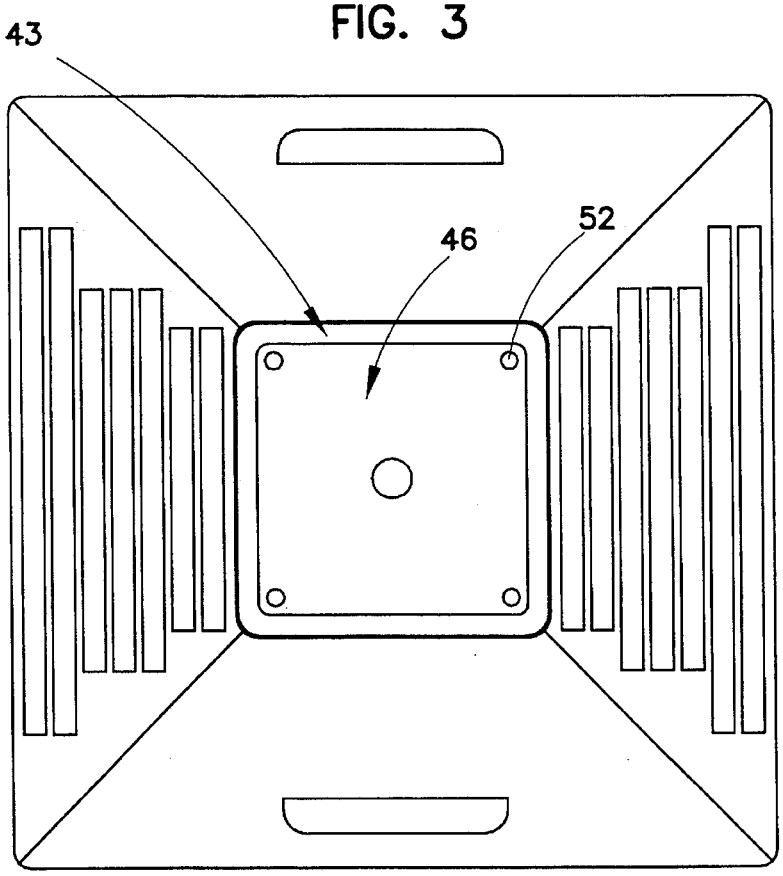
FIG. 4 is a bottom view of the tackle box portion of the embodiment shown in FIG. 1.
Figure 5:
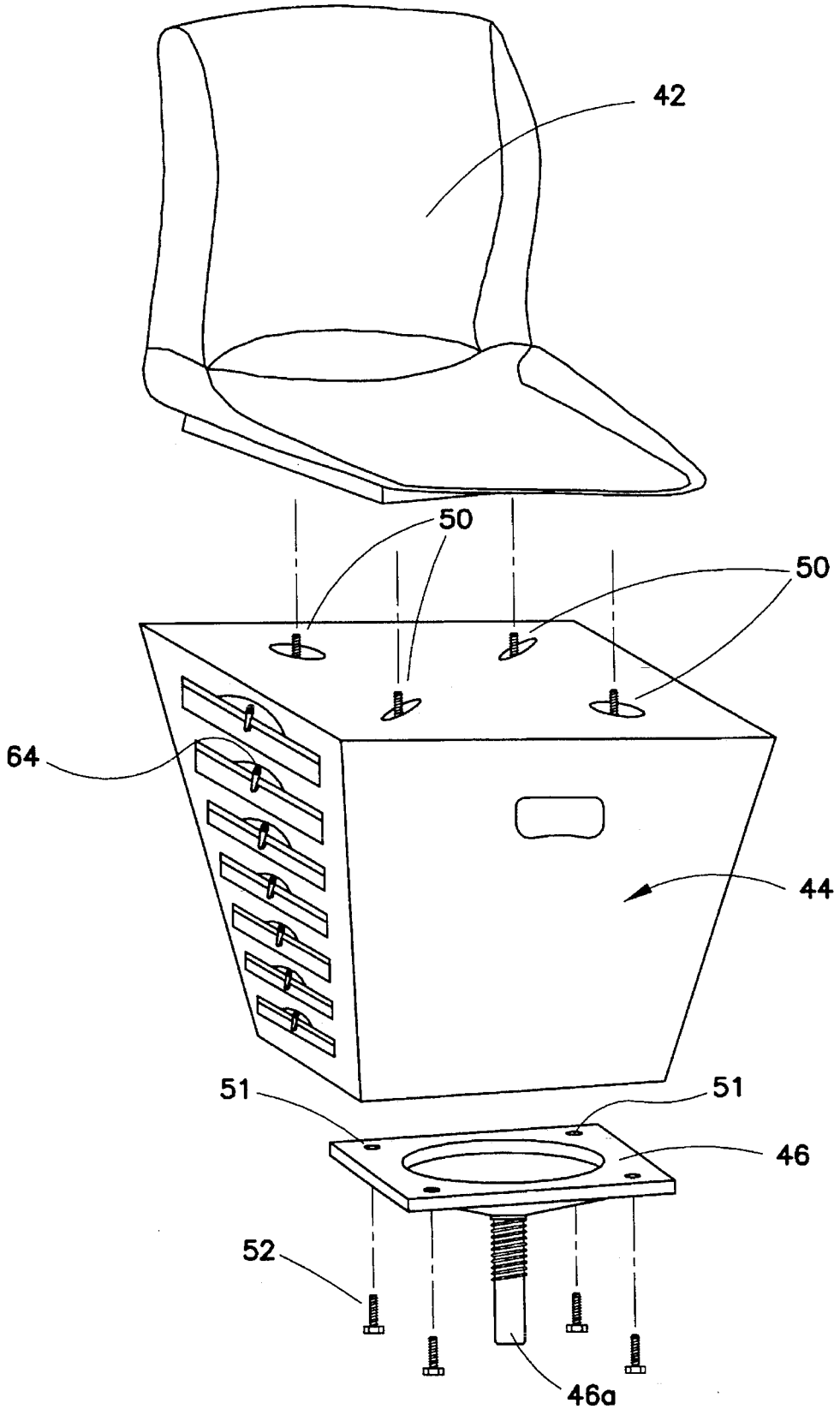
FIG. 5 is a perspective exploded view of the embodiment shown in FIG. 1.
Figure 6:
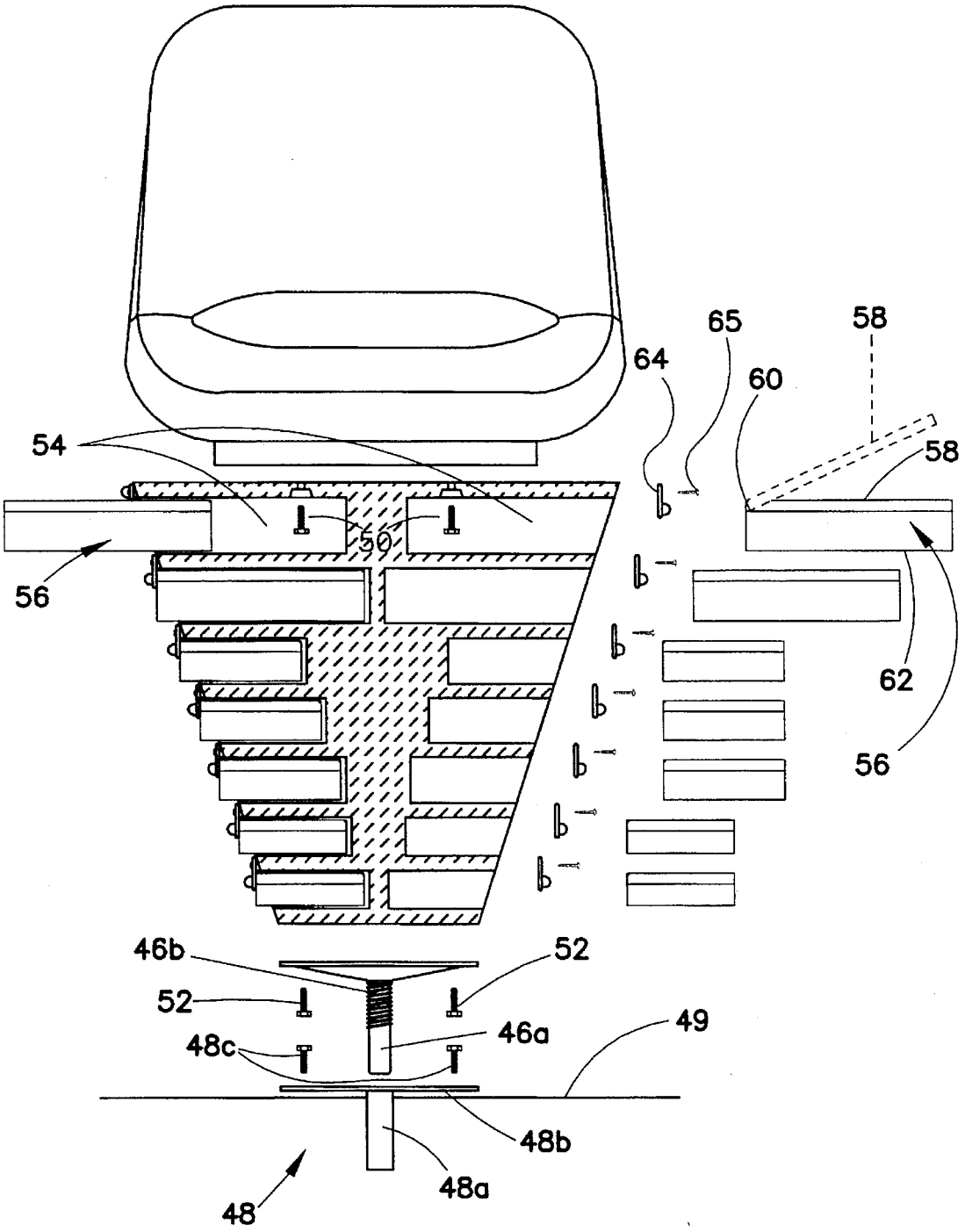
FIG. 6 is an exploded view, with portions cut away.
Figure 7:
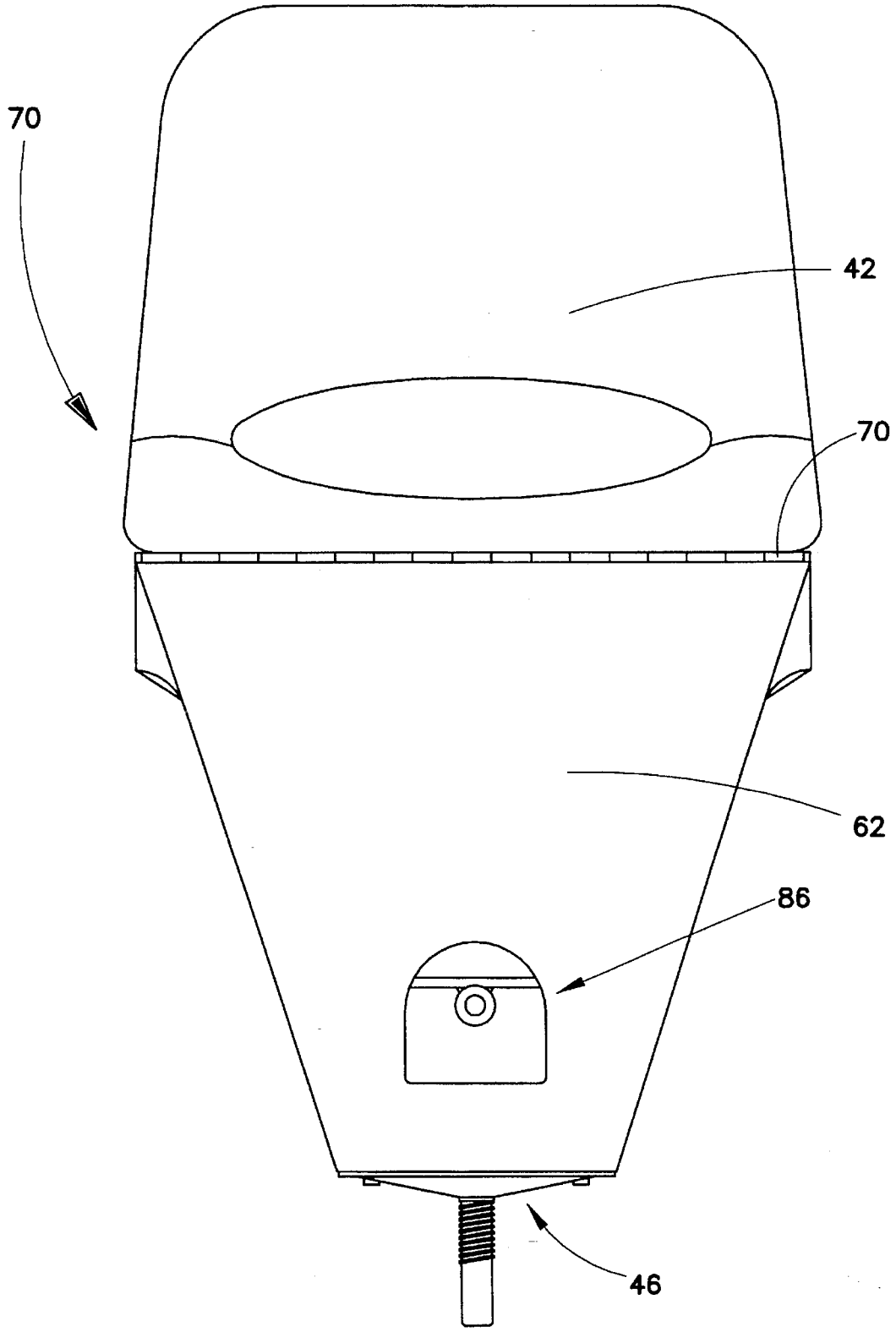
FIG. 7 is a rear elevational view of an embodiment of a pedestal mounted seat cooler assembly in accordance with the principles of the present invention.
Figure 8:
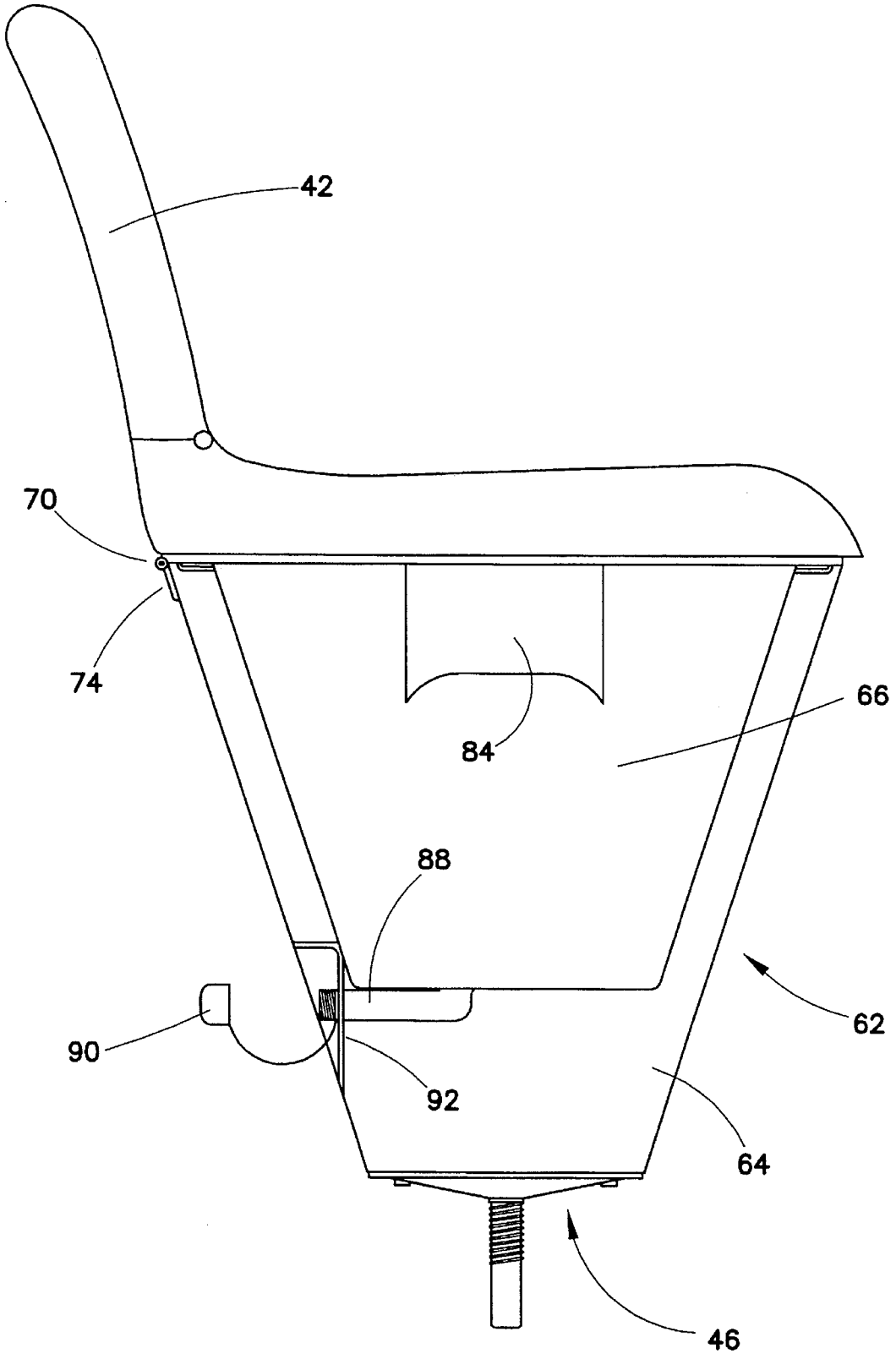
FIG. 8 is a side view of the embodiment of the pedestal mounted seat cooler assembly shown in FIG. 7.
Figure 9:
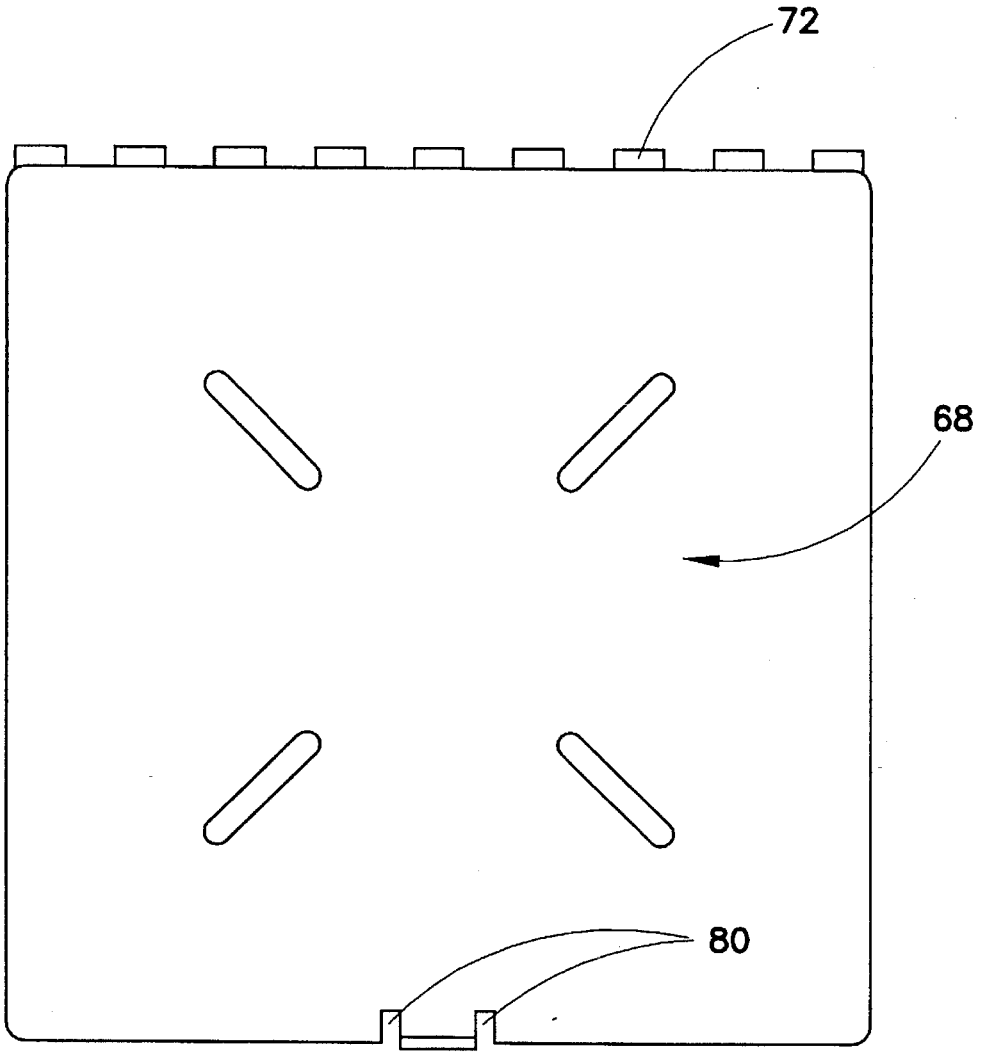
FIG. 9 is a top view of an embodiment of a lid for the cooler portion of the embodiment shown in FIG. 7.
Figure 10:
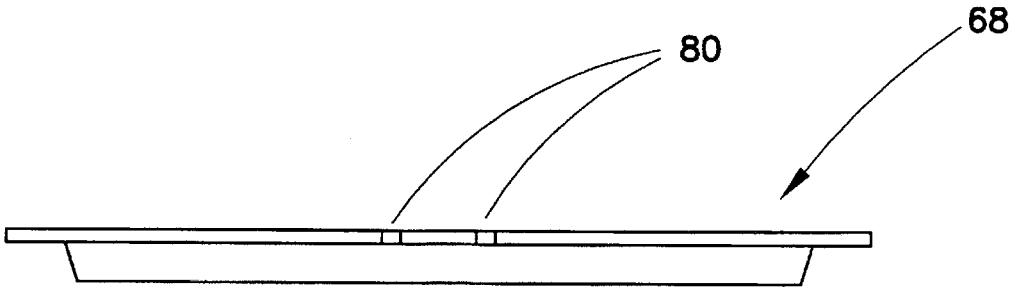
FIG. 10 is a front view of the cooler lid shown in FIG. 9 illustrating cut outs for receiving a latch on the cooler.
Figure 11:
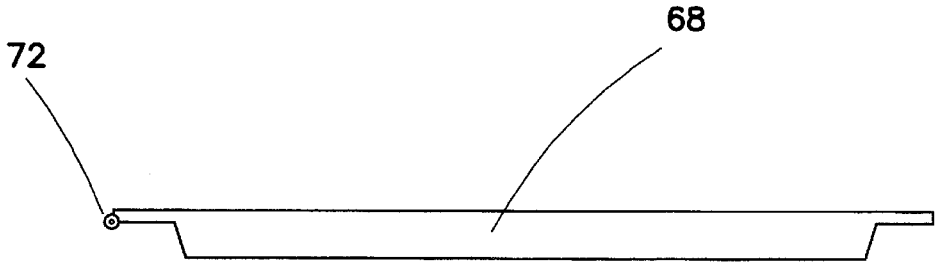
FIG. 11 is a side view of cooler lid shown in FIG. 9 illustrating a partial hinge molded into an edge of the cooler lid.
Figure 12:
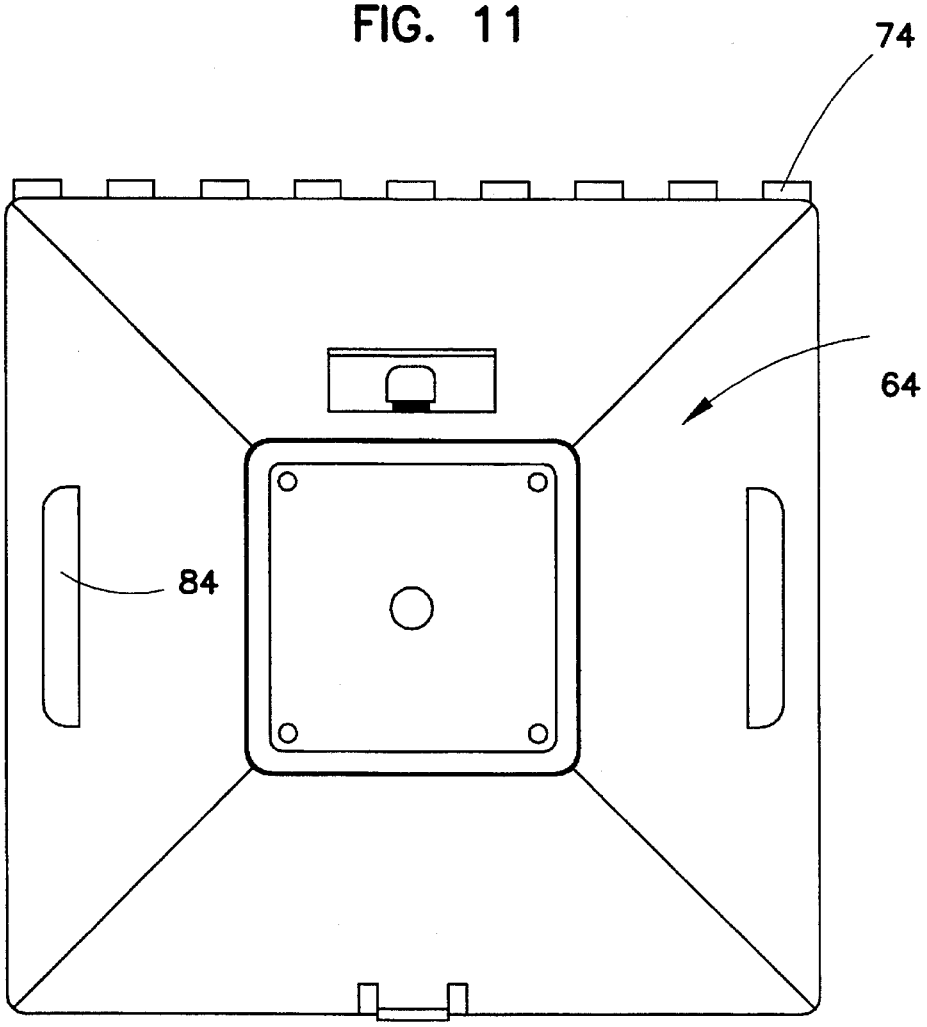
FIG. 12 is a bottom view of the embodiment shown in FIG. 7.
Figure 13:
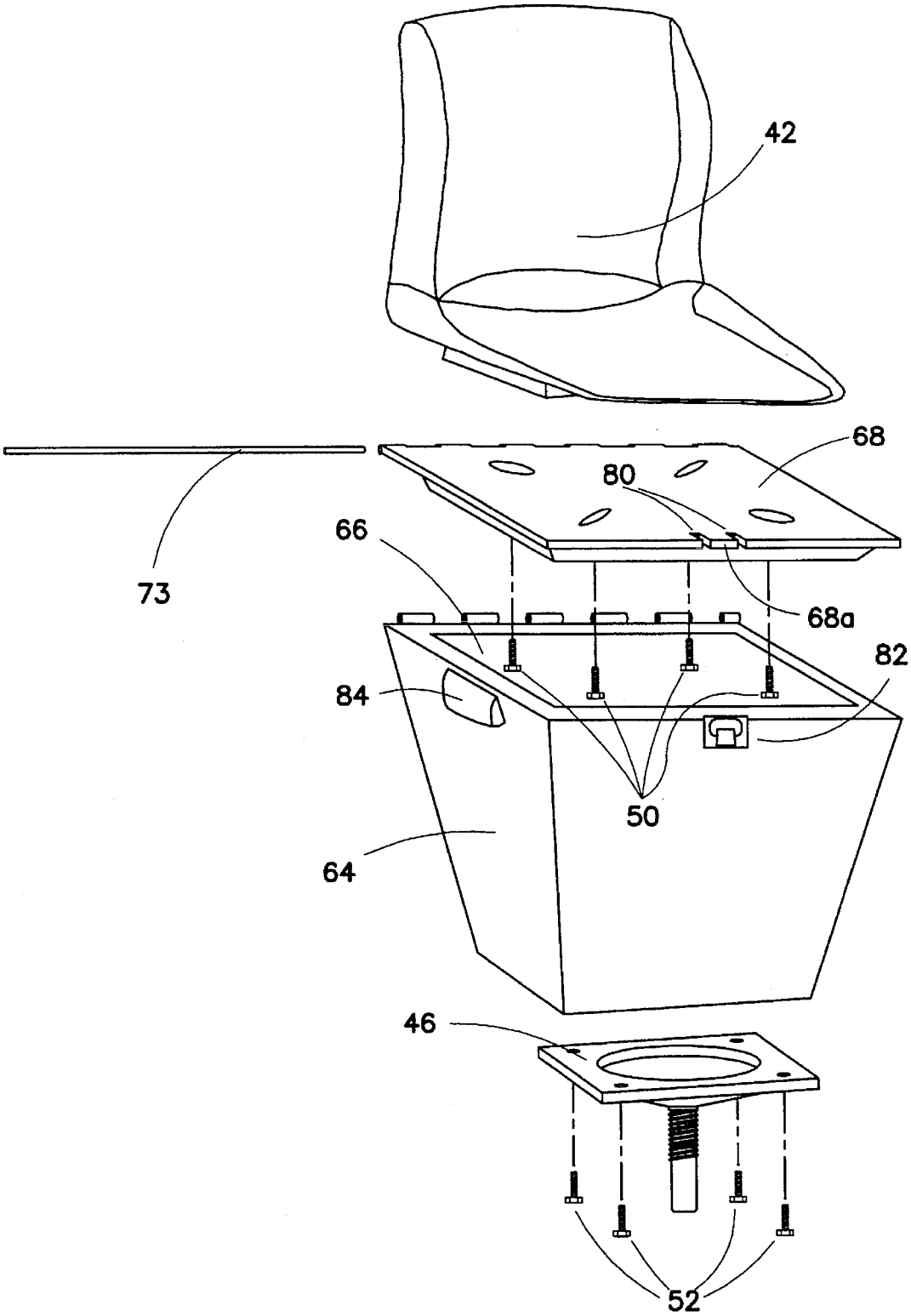
FIG. 13 is an exploded view of the embodiment of the pedestal mounted seat cooler assembly shown in FIG. 7.

While the two embodiments shown relate to a pedestal mounted seat tackle box assembly and a pedestal mounted seat cooler assembly, this is for illustration purposes only and it is not intended that the invention be limited to these two assemblies. The tackle box and/or cooler might be replaced by a storage base which is used to store various types of items.

Referring now to the drawings, there in shown in FIGS. 1–6 a preferred embodiment of a pedestal mounted seat tackle box assembly in accordance with the principles of the invention, the seat tackle box assembly generally referred to by the reference numeral 40. The seat tackle box assembly includes a seat 42, a tackle box 44, and a pedestal base plate adaptor 46 used to mount the seat tackle box assembly on a pedestal base plate 48 suitably mounted on a floor surface 49.

The seat 42 might have varying configurations and be made of varying materials. For example, the seat might be made of wood covered with fabric over cushions, molded plastic, or other suitable materials. In the embodiment shown the seat 42 is attached to a top of the tackle box 44 by suitable fasteners such as threaded fasteners 50. For example, if the suit is made of wood, threaded wood screws might be used.

The pedestal base plate adaptor 46 is attached to a bottom of the tackle box 44 by suitable fasteners such as threaded fasteners 52. In the embodiment shown the fasteners 52 might be threaded screws.

The tackle box 44 shown has a plurality of compartments 54 for slidable receipt of trays 56. In the embodiment shown, the trays 56 are removable from the compartments 54. In addition, some of the trays 56 shown include a cover 58 which is attached by a hinge 60 to a base 62 so as to enclose a compartment in the base. It will be appreciated that the trays 56 might have cover 58 which is simply removable from the base 62. In the embodiment shown, the trays 56 are held in the compartments 54 of the tackle box 44 by latches 64 which are pivotally attached to the tackle box 44 by threaded fasteners 65. When a person wishes to remove one of the trays 56, the tray's latch 64 is simply pivoted up out of the way and the tray 56 is removed. It will be appreciated that other configurations and arrangements of compartments and/or trays might be present in the tackle box 44.

In the embodiment shown, the top compartments 54 of the tackle box 44 are used to gain access to the threaded fasteners 50 so they can be threaded into a bottom of the seat 42. In addition, a top 45 of the tackle box 44 includes four slots 47 to allow adjustable positioning of the threaded fasteners 50.

The tackle box 44 and its trays 56 might be made of any suitable material such as molded plastic or the like.

The pedestal base plate adaptor 46 is shown attached to a bottom 43 of the tackle box by four of the threaded fasteners 52 which extend through apertures 51 in the adaptor 46.

It will be appreciated that there are various pedestal base plate floor mount designs and configurations. In the embodiment shown the base plate 48 includes a hollow cylinder **48*a* configured for receipt of a cylinder 46*a* extending down from the adaptor 46. In the embodiment shown, the cylinder 46*a* is threaded at 46*b* for threaded attachment to the hollow cylinder 48*a*. In yet other embodiments, the cylinder 46*a* might simply be slidably received in the hollow cylinder 48*a*. The base plate 48 includes a plate 48*b* which is suitably mounted to the floor 49 by threaded fasteners 48*c*. In the embodiment shown, the seat tackle box assembly is rotatably mounted in the base plate 48 so that the seat 42** can be swiveled.

In the embodiment shown, the tackle box 44 includes handles 41 so that the seat tackle box assembly 40 can be readily grasped.

Illustrated in FIGS. 7–14 is an embodiment of a seat cooler assembly 70 in accordance with the principles of the invention. In this embodiment, the seat 42 and the pedestal base plate adaptor 46 are the same as in the previous embodiment shown in FIGS. 1–6. As previously noted, these items might take on varying configurations and arrangements. In this embodiment, the tackle box 44 is replaced by a cooler 62. The cooler 62 includes a base 64 defining a compartment 66. A cover 68 is attached to the seat 42 as previous discussed above and is pivotally attached to a top side of the cooler base 64 by a hinge assembly 70. In the embodiment shown, the cover 68 includes a first half 72 of the hinge assembly 70 and the top edge of the base 64 includes a second half 74 of the hinge assembly 70. The two hinge parts 72 and 74 cooperate to form a hinge pin 73 receiving portion when the cover 68 is placed on the cooler base 64. The seat 42 is attached to the cover 68 by the threaded fasteners 50 so that the seat 42 pivots with the cover 68. Accordingly, the cooler compartment 66 can be covered and opened simply by pivoting the seat 42 about the hinge assembly 70.

In the embodiment shown, the cover 68 includes grooves 80 for receipt of a pivotable latch 82 so that the cover 68 can be latched onto the cooler base 64 simply by pivoting the latch 82 upward into the grooves 80 and over cover portion **68*a*. As with the tackle box 44, the cooler 66 includes handles 84 for lifting the seat cooler assembly 70**.

The preferred embodiment of the seat cooler assembly 70 includes a drain assembly 86 which has a drain pipe 88 and cap 90 threaded onto the end thereof. Preferably the threaded cap 90 is disposed in a molded recess 92 of the cooler 66.

Figure 14:
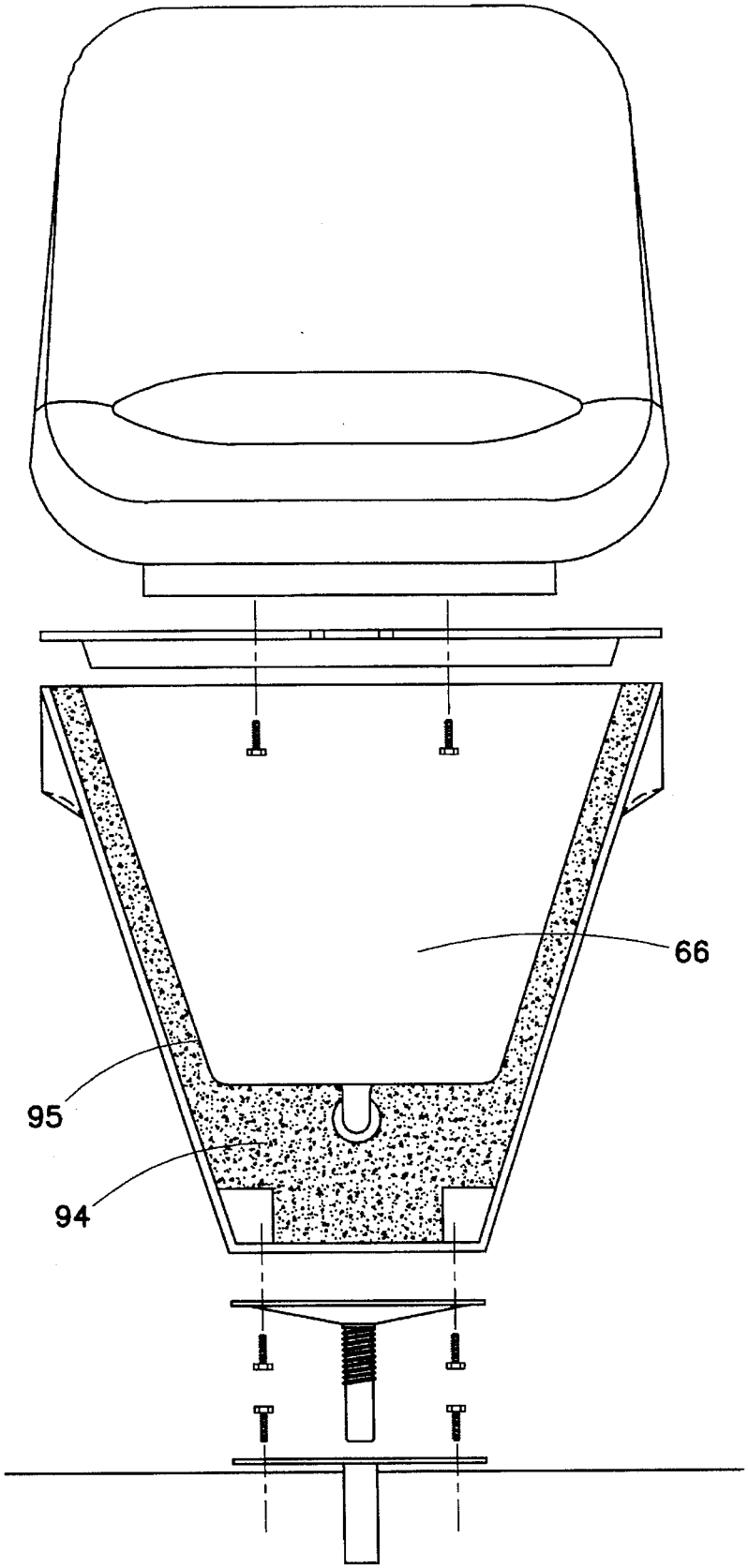
FIG. 14 is an exploded view of the embodiment of the pedestal mounted seat cooler assembly shown in FIG. 7, with portions being shown in section.

As illustrated in FIG. 14, the areas around an inner liner 95 of the cooler compartment 66 might be filled with insulating material 94 such as expanded polystyrene.

One application of the present invention is in a watercraft or fishing boat having a plurality of the pedestal base plates 48 with the seat tackle box assemblies 40 and/or seat cooler assemblies 70 are interchangeably mounted such that they can be moved around from one base plate to another.

Figure 15B:
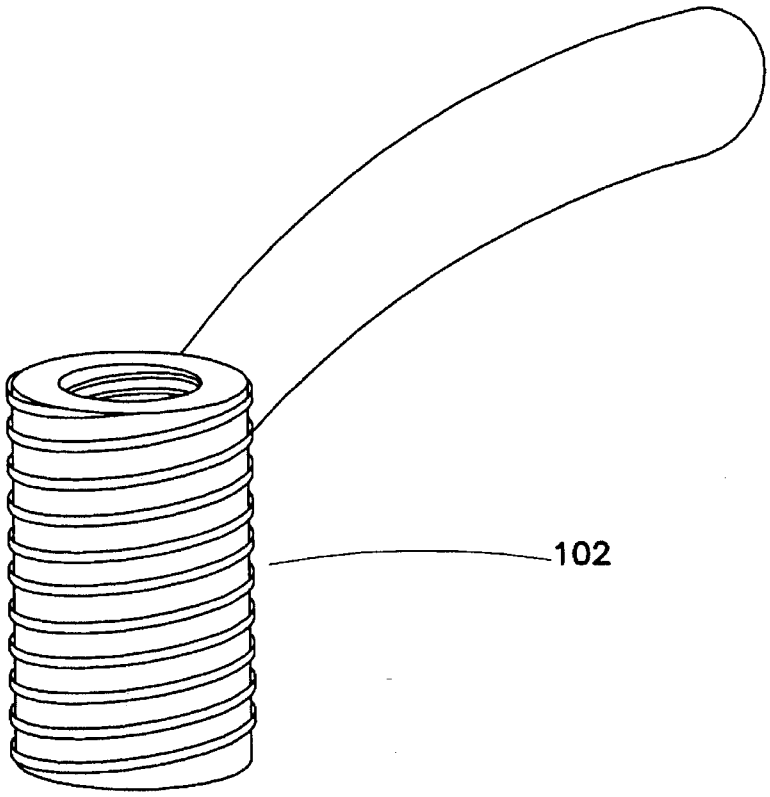
FIGS. 15A, B illustrate two embodiments of sleeves which might be used to mount the base of the embodiments shown in FIGS. 1 and 7 to various floor mounted pedestal supports.
Figure 15A:
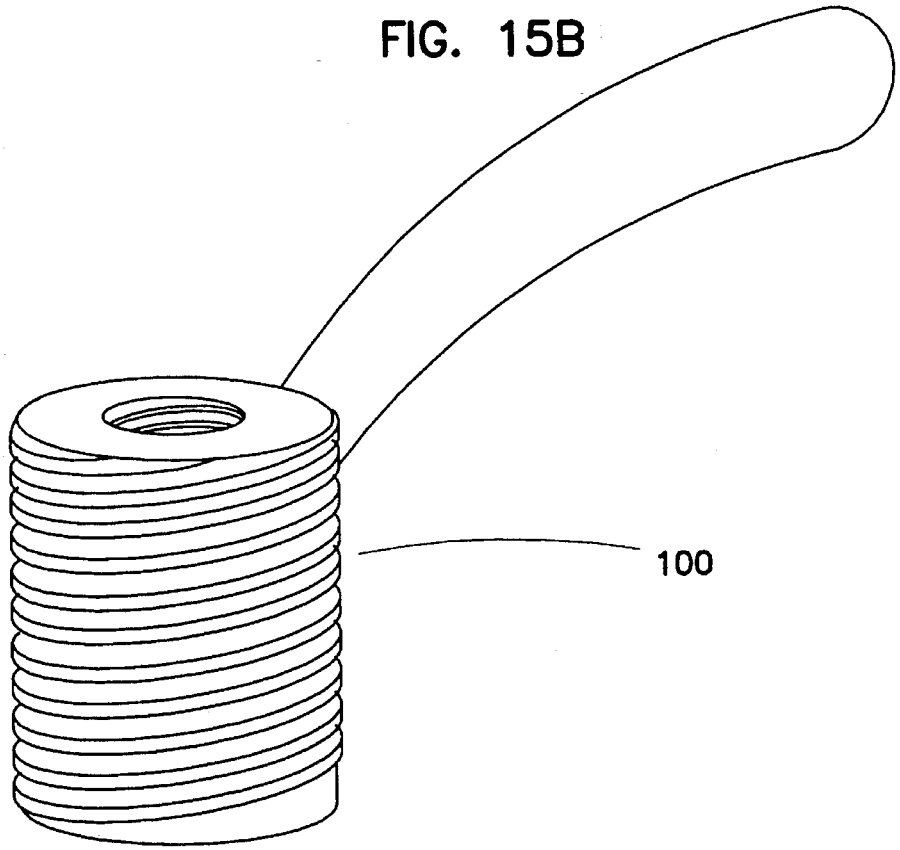

As noted above the present invention may be used with a variety of pedestal base plates. For example, FIGS. 15A,B illustrate an embodiment of two different type of adapters 100,102 that might be used to mount the seat tackle box and seat cooler assemblies on pedestal base plates having a larger diameter. The adapters 100,102 are sleeves having an outside diameter sized to fit in larger diameter pedestal base plates and an inside diameter sized to receive the smaller diameter shaft portions **46*a* of the pedestal base plate adapters 46**.

Having read the foregoing description, it is to be understood, that even though numerous characteristics and advantages of various embodiments in accordance with the principles of the invention have been set forth in the foregoing description, together with details of the structure and function of the invention, the disclosure is illustrative only, and changes may be made in detail, especially matters of shape, size and arrangement of the parts within the principles of the invention to the full extent indicated by the broad general meaning of the term in which the appended claims are expressed.

What is claimed is:

1. A pedestal mounted seat storage base assembly for mounting on a pedestal base plate commonly used for supporting a standard pedestal seat assembly, the seat storage base assembly comprising:

a storage base defining a storage space and having a top and a bottom;

a seat mounted on the top of the storage base, whereby the storage space is disposed vertically beneath the seat; and a pedestal base plate adaptor mounted on the bottom of the storage base, the pedestal base plate adaptor having a vertically extending post removably and rotatably received by the pedestal base plate such that the storage base may rotate with respect to the pedestal base plate, whereby the seat storage base assembly may be interchanged with a standard pedestal seat assembly.

2. An assembly in accordance with claim 1 wherein the storage base includes a plurality of compartments.

3. An assembly in accordance with claim 2 wherein at least some of the compartments receive removable trays.

4. An assembly in accordance with claim 1 wherein the storage base includes compartment enclosed by a pivotal cover mounted to the seat whereby the compartment can be opened by pivoting the seat.

5. An assembly as recited in claim 1, wherein a portion of the post has a cross-sectional area less than a cross-sectional area of the assembly.

6. An assembly as recited in claim 1, wherein the storage base includes sides, a major portion of at least one of the sides being tapered such that the storage base has a lesser footprint proximate its bottom than proximate its top.

7. A fishing boat pedestal mounted seat tackle box assembly for mounting on a floor mounted pedestal base plate commonly used for supporting a standard pedestal seat assembly, the seat tackle box assembly comprising:

a compartmented tackle box having a top and a bottom;

a seat mounted on the top of the compartmented tackle box, whereby the tackle box is disposed vertically beneath the seat; and a pedestal base plate adaptor mounted on the bottom of the tackle box, the pedestal base plate adaptor having a vertically extending post removably and rotatably received by the pedestal base plate such that the tackle box may rotate with respect to the pedestal base plate, whereby the seat tackle box assembly may be interchanged with a standard pedestal seat assembly.

8. An assembly in accordance with claim 7 wherein the compartmented tackle box includes a plurality of removable trays.

9. An assembly in accordance with claim 8 wherein the trays are held in place by a pivotal latch.

10. An assembly in accordance with claim 8 wherein the trays include at least one articulated section and a non-articulated section.

11. An assembly in accordance with claim 7 wherein the tackle box has a lesser footprint proximate its bottom than proximate its top.

12. An assembly as recited in claim 7, wherein a portion of the post has a cross-sectional area less than a cross-sectional area of the storage base.

13. An assembly as recited in claim 11, wherein the tackle box includes sides, a major portion of at least one of the sides being tapered such that the tackle box has the lesser footprint proximate its bottom than proximate its top.

14. An assembly as recited in claim 13, wherein the tackle box has a substantially truncated conical shape.

15. A fishing boat pedestal mounted seat cooler assembly for mounting on a floor mounted pedestal base plate commonly used for supporting a standard pedestal seat assembly, the seat cooler assembly comprising:

a cooler having a top and a bottom;

a seat mounted on the top of the cooler, whereby the cooler is disposed vertically beneath the seat; and a pedestal base plate adaptor mounted on the bottom of the cooler, the pedestal base plate adaptor having a vertically extending post removably and rotatably received by the pedestal base plate such that the cooler may rotate with respect to the pedestal base plate, whereby the seat cooler assembly may be interchanged with a standard pedestal seat assembly.

16. An assembly in accordance with claim 15 wherein the cooler has a lesser footprint proximate its bottom than proximate its top.

17. An assembly in accordance with claim 15 wherein the cooler includes a pivotally mounted cover enclosing a cooler compartment, the cover being attached to the seat whereby the cooler can be opened by pivoting the seat.

18. A fishing boat, comprising:

a plurality of floor mounted pedestal base plates commonly used for supporting a standard pedestal seat assembly, at least on one seat storage base assembly interchangeably mountable on the pedestal base plates, the seat storage base assemblies including:

a storage base having a top and a bottom;

a seat mounted on top of the storage base, whereby the storage base is disposed vertically beneath the seat; and a pedestal base plate adaptor mounted on the bottom of the base, the pedestal base plate adaptor having a vertically extending post removably and rotatably received by the pedestal base plate such that the storage base may rotate with respect to the pedestal base plate, whereby the seat storage base assembly may be interchanged with a standard pedestal seat assembly.

19. A fishing boat in accordance with claim 18 including at least one seat storage base assembly wherein the storage base is a compartmented tackle box.

20. A fishing boat in accordance with claim 18 including at least one seat storage base assembly wherein the storage base is a cooler.

21. A fishing boat as recited in claim 18, wherein a portion of the post has a cross-sectional area less than the cross-sectional area of the storage base.

22. A fishing boat as recited in claim 18, wherein the fishing boat includes at least one seat assembly, the seat storage base assembly being interchangeable with the seat assembly.

* * * * *